US008769759B2

(12) United States Patent
Xia

(10) Patent No.: US 8,769,759 B2
(45) Date of Patent: Jul. 8, 2014

(54) TOILET RIM AND SEAT CLEANING TONGS

(76) Inventor: Ming Xia, Calgary (CA)

( * ) Notice: Subject to any disclaimer, the term of this patent is extended or adjusted under 35 U.S.C. 154(b) by 312 days.

(21) Appl. No.: 13/175,866

(22) Filed: Jul. 3, 2011

(65) Prior Publication Data

US 2013/0000067 A1 Jan. 3, 2013

(51) Int. Cl.
*A47K 11/10* (2006.01)

(52) U.S. Cl.
USPC ..... 15/210.1; 15/143.1; 15/231

(58) Field of Classification Search
USPC ..... 15/231, 143.1, 147–147.2, 150–151, 15/209.1–210.1; 294/16, 118; 606/208
See application file for complete search history.

(56) References Cited

U.S. PATENT DOCUMENTS

| | | | | |
|---|---|---|---|---|
| 776,879 | A * | 12/1904 | Wolfe | 7/107 |
| 1,607,204 | A * | 11/1926 | Linzmaier | 294/118 |
| 4,063,316 | A | 12/1977 | Hüninghaus | |
| 4,120,302 | A * | 10/1978 | Ziegler | 606/207 |
| 4,924,532 | A | 5/1990 | Pennestri | |
| 5,473,789 | A | 12/1995 | Oster | |
| 5,596,774 | A | 1/1997 | Howard | |
| 5,630,243 | A | 5/1997 | Federico et al. | |
| 5,806,105 | A | 9/1998 | Yu | |
| 5,813,057 | A | 9/1998 | Descent et al. | |
| 5,941,379 | A | 8/1999 | Barardo | |
| 7,509,693 | B1 | 3/2009 | Graves et al. | |
| D620,568 | S | 7/2010 | Giovannoni | |
| 7,810,859 | B1 * | 10/2010 | Montusi | 294/1.3 |
| 8,151,400 | B2 * | 4/2012 | McCoy | 15/210.1 |

FOREIGN PATENT DOCUMENTS

| | | | | |
|---|---|---|---|---|
| JP | 9-154770 A * | 6/1997 | | A47K 11/10 |
| JP | 2005-230498 A * | 9/2005 | | A47K 11/10 |

* cited by examiner

*Primary Examiner* — Laura C Guidotti

(57) ABSTRACT

A pair of Toilet Rim and Seat Cleaning Tongs. This invention provides people with a convenient apparatus and a new method for cleaning the rim of a toilet bowl and the seat of a toilet. This apparatus consists of only three pieces of components, which are a gripping member, an opposite gripping member, and a slide knob. The opposite gripping member is mounted on the gripping member via a pivot. The opposite gripping member rotates around the pivot and works together with the gripping member to achieve clamping function. The steps on the apparatus are designed to raise handles above a cleaning surface. And slide knob is designed to dispose used toilet paper. There are four easy steps to complete a cleaning process using this apparatus, which are "Load Toilet Paper", "Wrap and Clamp Toilet Paper", "Clean Up", and "Dispose Used Toilet Paper".

12 Claims, 11 Drawing Sheets

Figure 1:
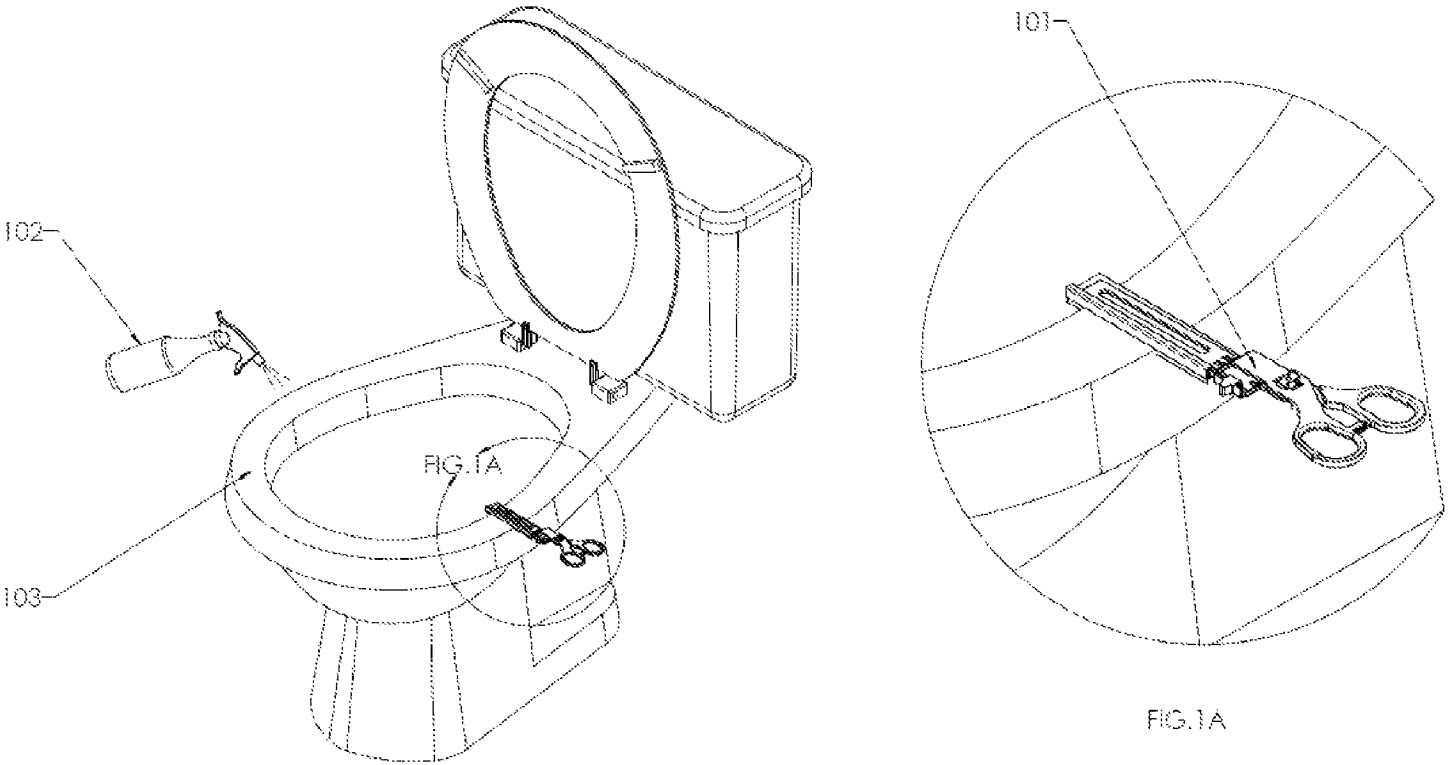

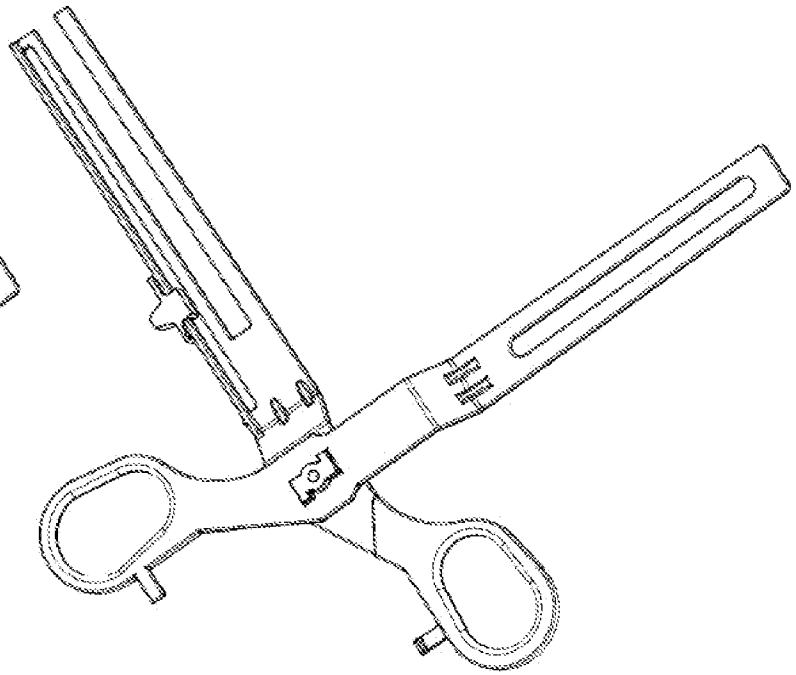
FIG.7B
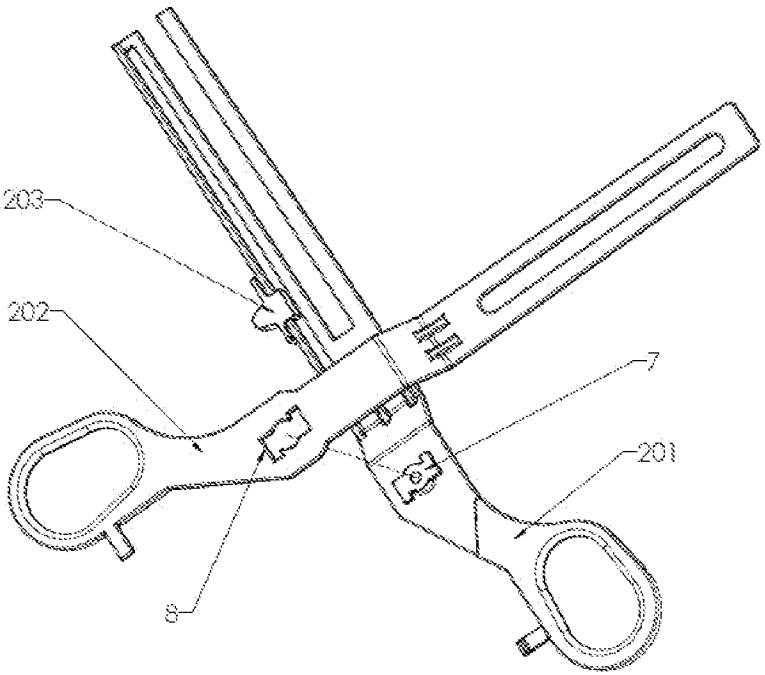
FIG.7A
FIG.7

TOILET RIM AND SEAT CLEANING TONGS

I. CROSS-REFERENCE TO RELATED APPLICATIONS

Not Applicable

II. STATEMENT REGARDING FEDERALLY SPONSORED RESEARCH OR DEVELOPMENT

Not Applicable

III. REFERENCE TO SEQUENCE LISTING, A TABLE, OR A COMPUTER PROGRAM LISTING COMPACT DISC APPENDIX

Not Applicable

IV. BACKGROUND OF THE INVENTION

1. Field of the Invention

This invention relates to an apparatus and a method for cleaning the rim of a toilet bowl and the seat of a toilet.

This apparatus is invented for cleaning the rim of a toilet bowl and the seat of a toilet in a home washroom or in a public washroom. It may be used by a toilet user when necessary and be used by a janitor for maintenance purpose.

2. Discussion of Related Art

In ordinary life, the rim of a toilet bowl is easy to collect some urine drops, hair, and some other residues. The toilet seat is also easy to get dirty. When a next toilet user comes and faces this kind of situation, usually the user wants to wipe the dirty things off before the user feels comfortable to use the toilet.

Usually people either tear of a piece of toilet paper to wipe off the contaminations with their bare hands, or put on gloves to do that. Obviously there is a risk to make their hands dirty if using bare hands. However it is not convenient to put on gloves to clean the seat and/or the rim of a toilet just before they are in a hurry to use it. Gloves, toilet bowel brushes, and sponges are the common tools that are often used in cleaning a toilet. They are good for a janitor or a housewife who is generally responsible for maintaining toilets periodically. But these tools are not good for a toilet user. Firstly they are inconvenient for cleaning the rim and the seat of a toilet. Secondly the toilet bowel brushes and sponges themselves may be contaminated because of repeatedly being used.

Disposable toilet seat covers have been used to prevent a user from directly contacting with the toilet seat surface. Disposable cleaning gloves are good for cleaning the rim and the seat of a toilet. However both of them are more expensive consuming methods. When the seat surface is wet, a disposable toilet seat cover does not work very well.

In U.S. Pat. No. 5,630,243, a Toilet Cleaning Device with Cleaning Pad is invented. This device is complex, thus it costs more to make it. And it requires using a pair of disposable pads each time, which will cost even more.

In U.S. Pat. No. 5,941,379, a Toilet Rim Cleaning Apparatus is invented. This apparatus can be used to clean the rim of a toilet bowel. No information shows that it has the function of cleaning the seat of a toilet.

In U.S. Pat. No. 7,509,693 B1, a Toilet Cleaning Apparatus is invented. This apparatus is actually a toilet seat with a built-in electrical motor. This built-in motor provides a function of automatically cleaning the rim of a toilet bowel. But its cleaning function does not include the seat of a toilet. And the cost of this apparatus is high.

In U.S. Pat. No. 5,596,774, a Self Cleaning Toilet is invented. This invention changed the design of a toilet bowel. The newly designed toilet bowel has a self-cleaning hollow rim. The contaminations on the top surface of the rim are rinsed during flushing of the toilet. This is a new design for a toilet bowel. It is not a cleaning apparatus for commonly used existing toilets.

Traditional methods and existing apparatus can not meet people's day-to-day needs in this situation, where a toilet user needs to clean either the rim or the seat, sometimes both of them with a convenient and inexpensive tool before the user uses the toilet. The present invention aims to help people to deal with this unavoidable and unpleasant situation easily and quickly. It presents a convenient and inexpensive apparatus for cleaning the rim and/or the seat of a toilet effectively. With this apparatus a user can keep his/her hand clean when he/she wipes the rim and the seat of a toilet.

V. BRIEF SUMMARY OF THE INVENTION

The present invention is a pair of Toilet Rim and Seat Cleaning Tongs. Considering the current situation that people do not have a suitable tool to clean the rim and the seat of a toilet, this invention aims to provide people with a convenient apparatus and a new method for cleaning the rim of a toilet bowl and the seat of a toilet. With this invention people do not have to use their bare hands to clean the rim and the seat of a toilet as most people do now. The design of this apparatus has successfully achieved simplicity of mechanism meanwhile it has very good full function. Comparing with other inventions in the literature of this field, the present invention is much easier to make and its cost is much more inexpensive. It is also easy to operate and easy to maintain.

VI. DETAILED DESCRIPTION OF THE DRAWINGS

FIG. 1 shows the method of cleaning the rim of a toilet bowl 103 using this invention 101. Firstly use a sprayer 102 to spray water or cleaning solution on the rim 103. Then clean the rim 103 using the invention 101 loaded with a strip of toilet paper. FIG. 1A shows a detail view around the invention in the FIG. 1.

Figure 2A:
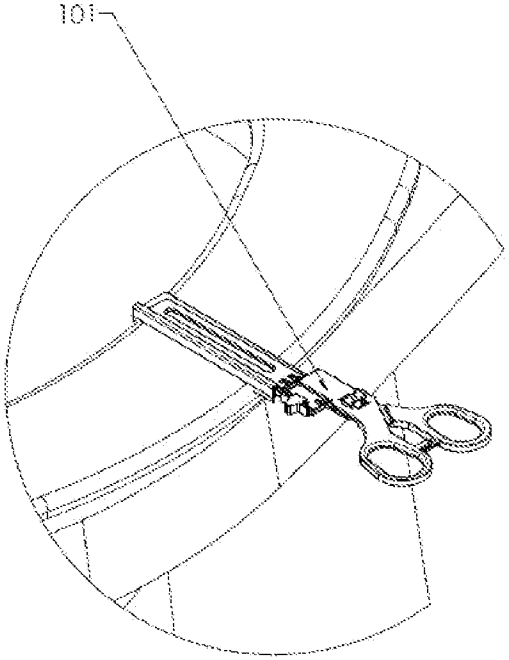
Figure 2:
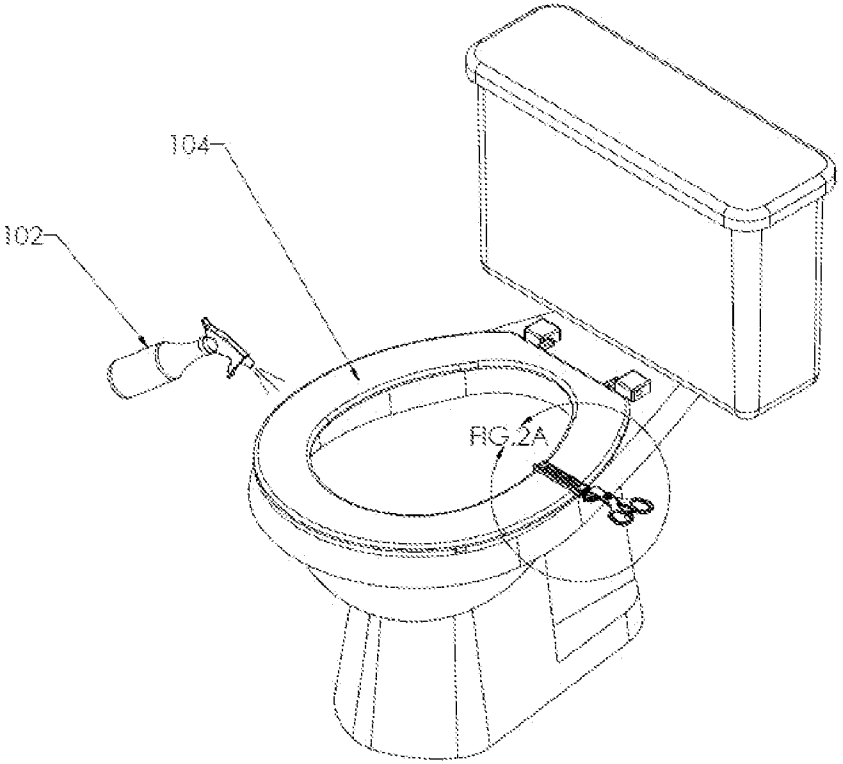

FIG. 2 shows the method of cleaning the seat of a toilet 104 using this invention 101. Firstly spray water or cleaning solution on the seat 104. Then clean the seat 104 using the invention 101 loaded with a strip of toilet paper. FIG. 2A shows a detail view around the invention in the FIG. 2.

Figure 3:
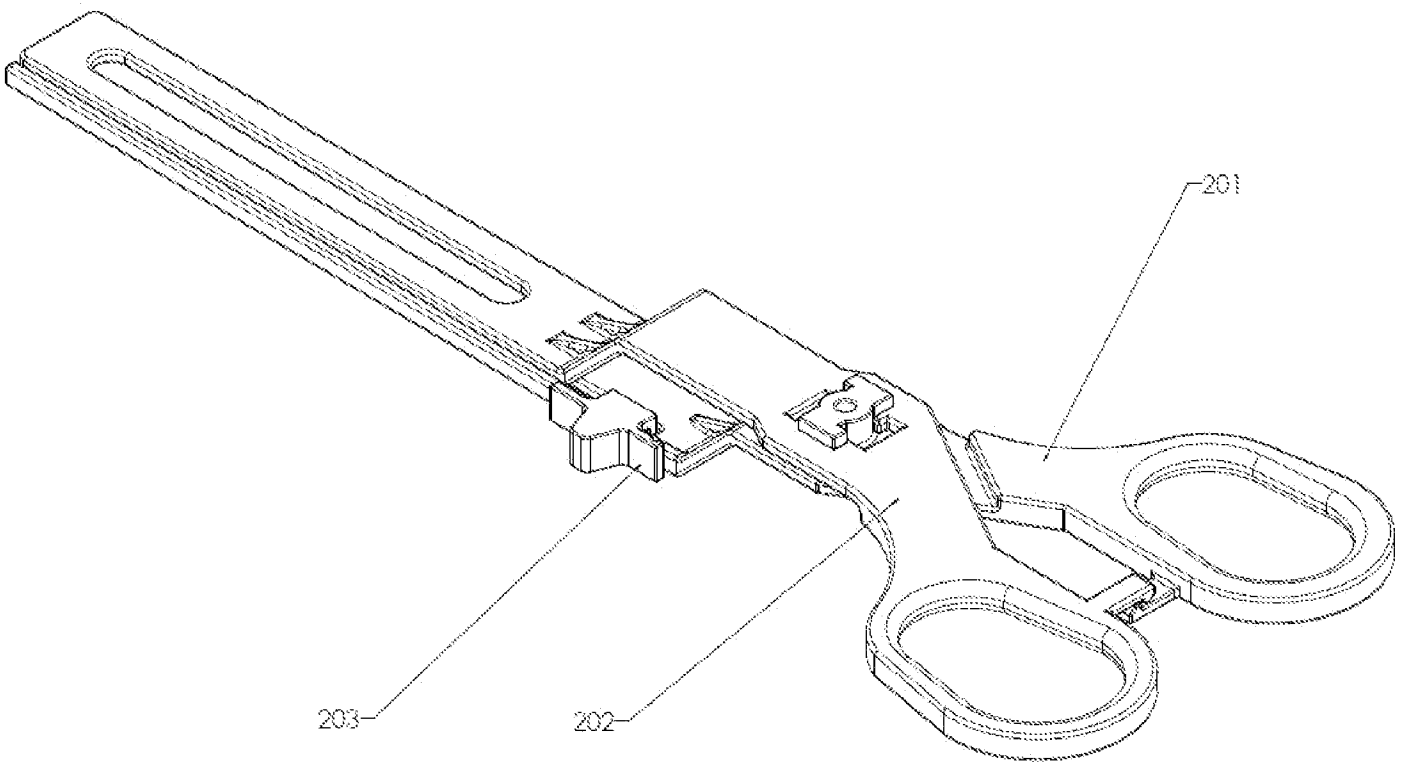

FIG. 3 is an isometric view of the invention. This invention consists of 3 parts: gripping member 201, opposite gripping member 202, and slide knob 203.

Figure 4:
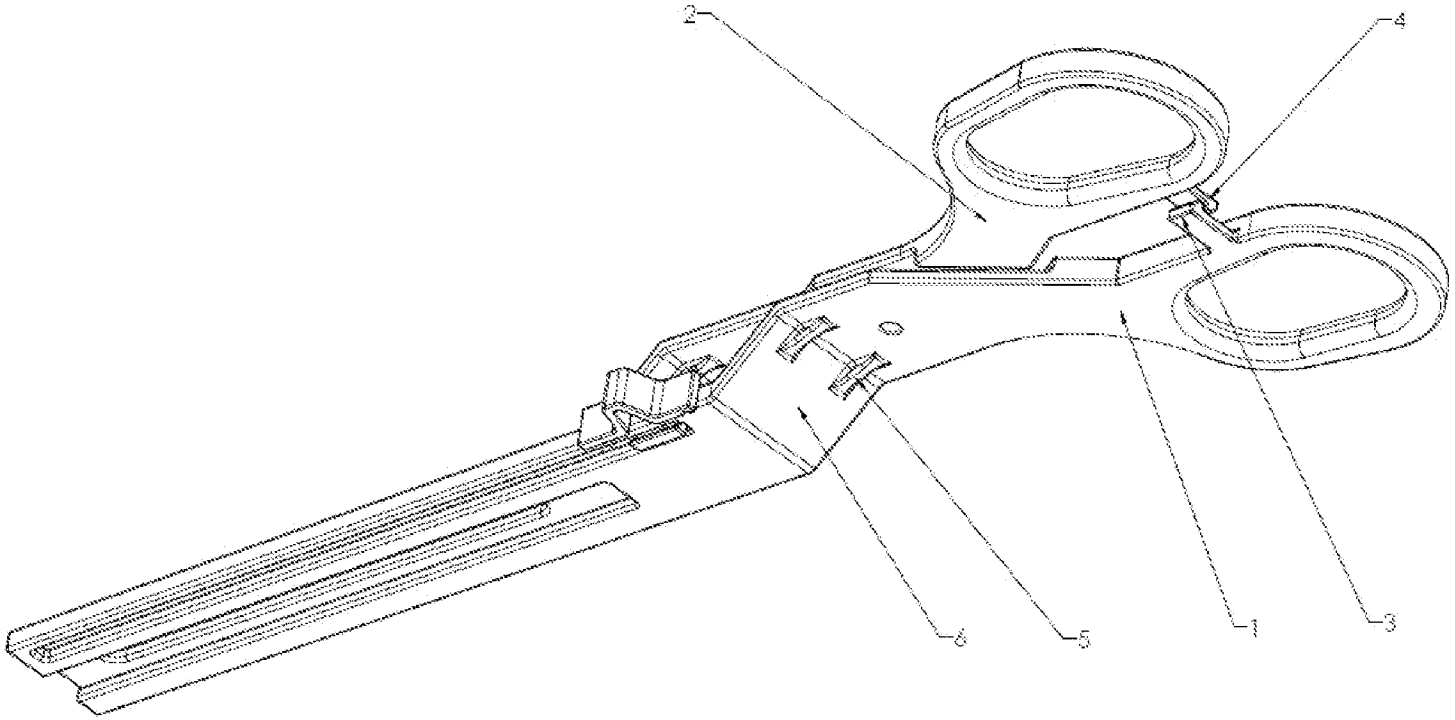

FIG. 4 shows some features of this invention including handle 1, opposite handle 2, ratchet tooth 3, opposite ratchet tooth 4, rib stiffeners on gripping member 5, and step on gripping member 6 from bottom of view.

Figure 5:
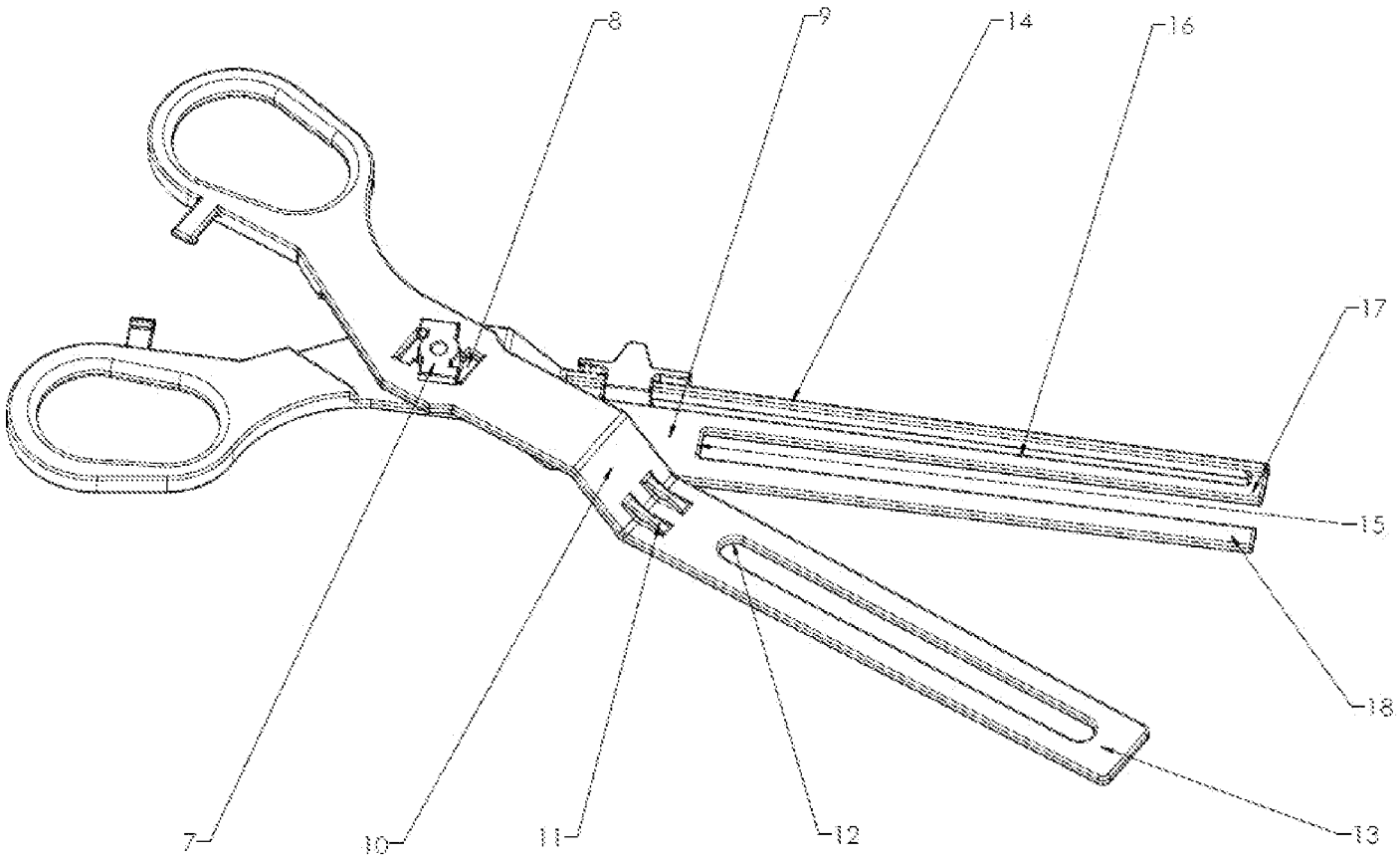

FIG. 5 shows some major features of this invention including pivot 7, pivot fitting hole 8, gripping end 9, step on opposite gripping member 10, rib stiffeners on opposite gripping member 11, slot on opposite gripping end 12, opposite gripping end 13, slide track 14, toilet paper loading slot 15, slide slot 16, outer beam 17, and inner beam 18.

Figure 6:
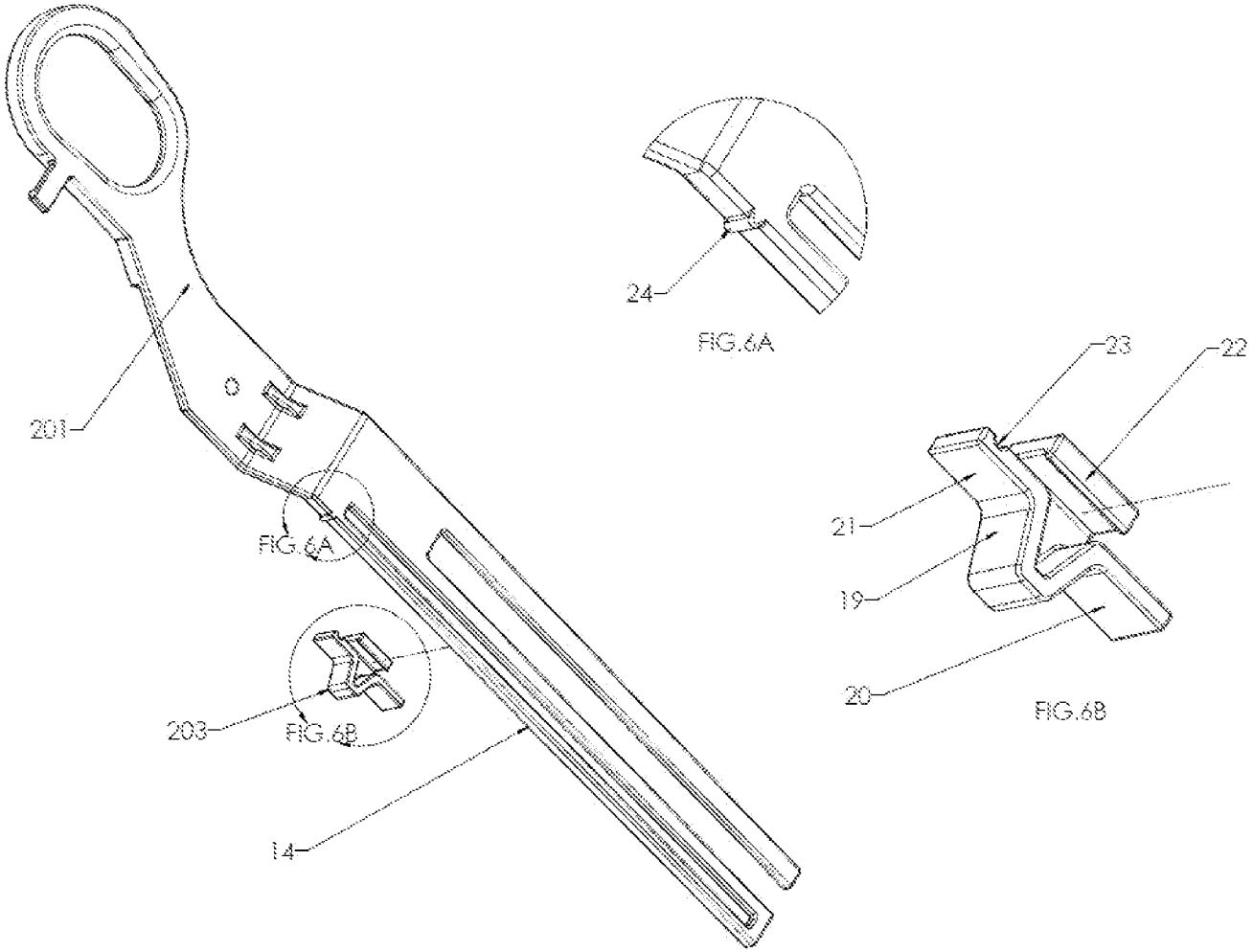

FIG. 6 shows assembling step 1 of the invention. Clip the slide knob 203 onto slide track 14. FIG. 6A is a detail view of half-cylindrical groove fitting 24 on gripping member 201. FIG. 6B shows the features of slide knob 203 including pushing knob 19, pushing wing 20, holding wing 21, slide track clamp 22, and half-cylindrical groove 23.

FIG. 7 shows assembling step 2 of the invention. Firstly align pivot 7 with pivot fitting hole 8 as shown in FIG. 7A. Then assemble opposite gripping member 202 onto gripping member 201 as shown in FIG. 7B.

Figure 8:
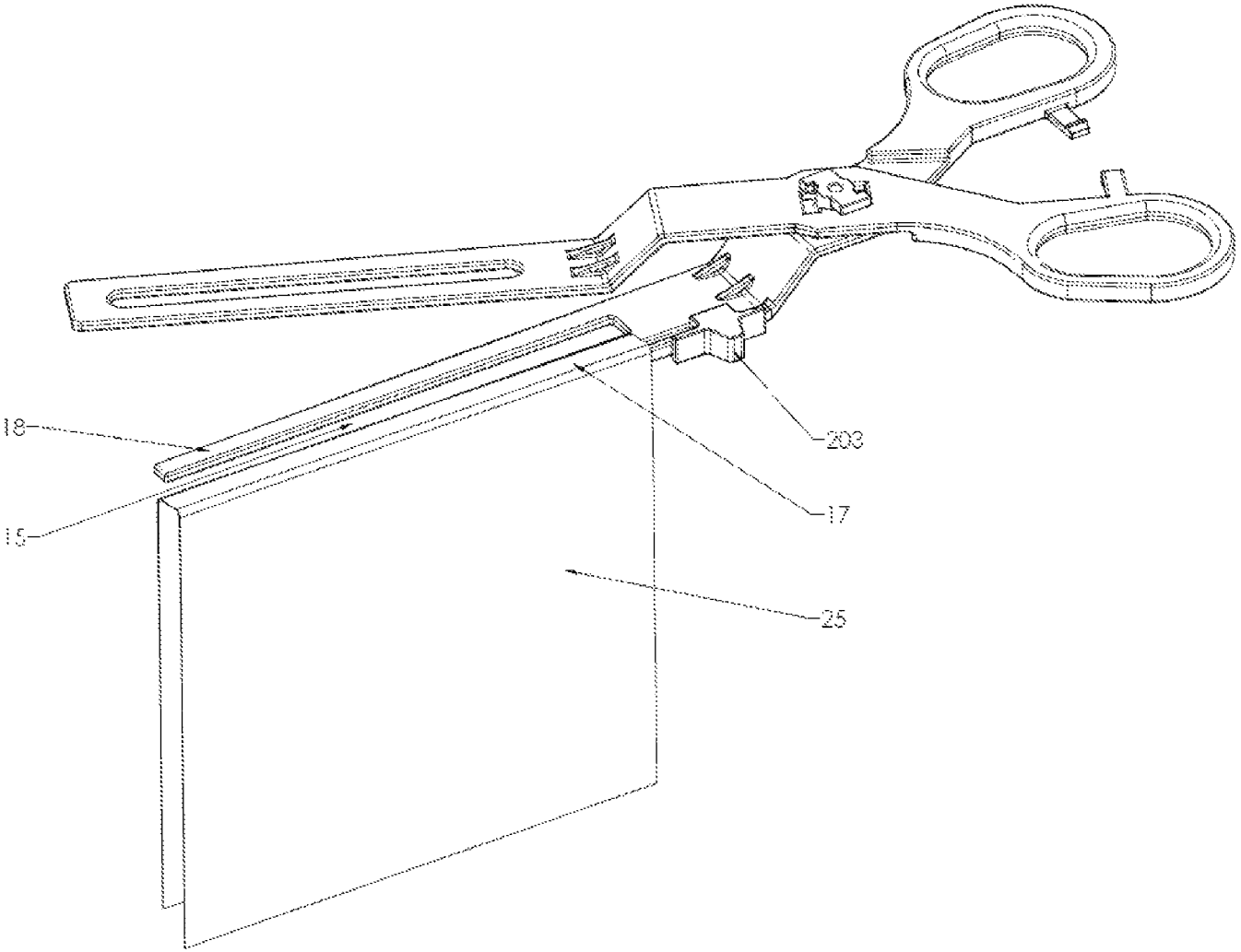

FIG. 8 shows step 1 of using the apparatus. A strip of toilet paper 25 goes through toilet paper loading slot 15 and hangs on outer beam 17. Slide knob 203 is sitting at holding place at this step.

Figure 9:
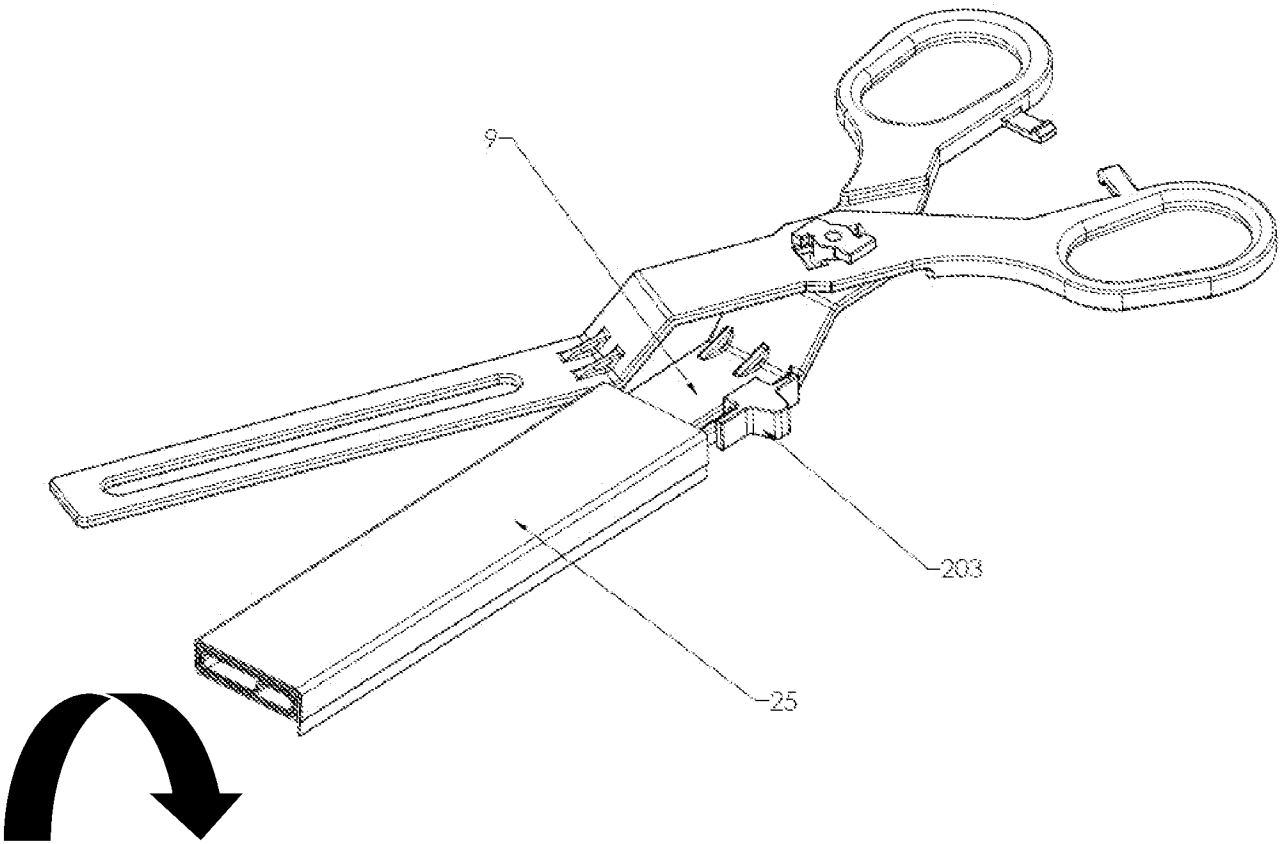

FIG. 9 shows step 2 of using the apparatus. Roll up the strip of toilet paper 25 around the gripping end 9 as shown in this figure.

Figure 10:
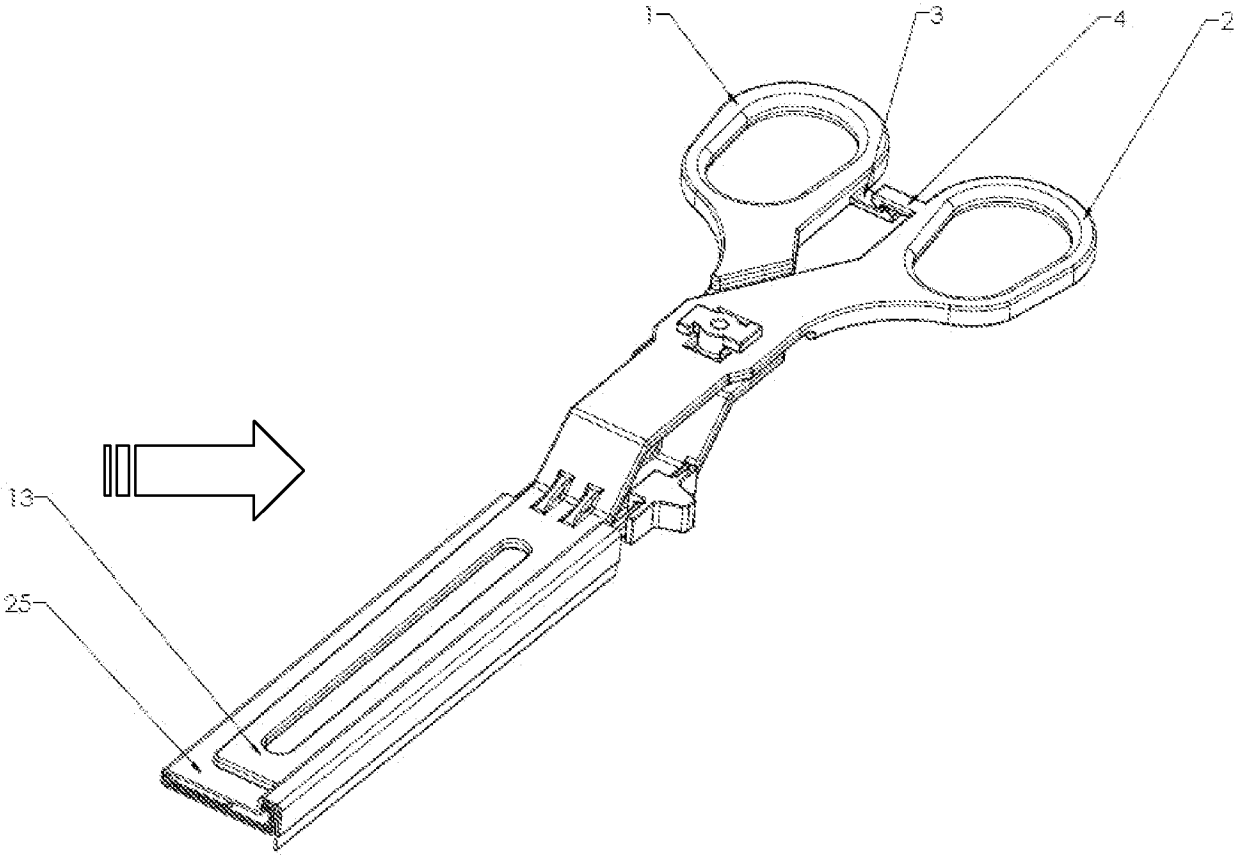

FIG. 10 shows step 3 of using the apparatus. Close handle 1 and handle 2, click ratchet tooth 3 and opposite ratchet tooth 4. The toilet paper 25 is clamped and the apparatus is ready to use.

Figure 11:
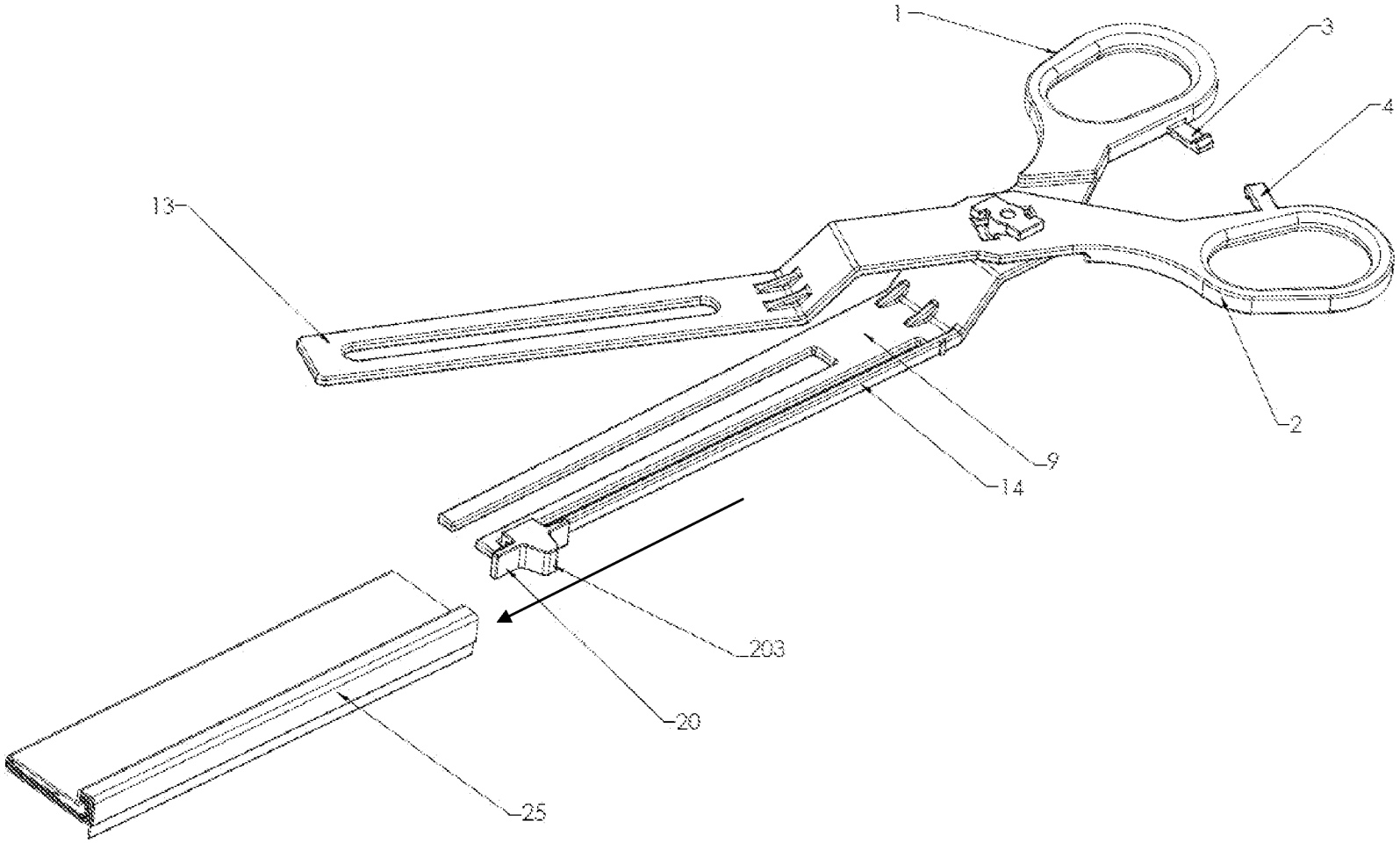

FIG. 11 shows step 4 of using the apparatus. After cleaning a toilet, open the handles 1 and 2. Push the slide knob 203 along the slide track 14. Pushing wing 20 pushes the used toilet paper roll 25 out of the gripping end 9.

VII. DETAILED DESCRIPTION OF THE INVENTION

The Toilet Rim and Seat Cleaning Tongs are made of plastics and only consist of three components. It includes a gripping member 201, an opposite gripping member 202, and a slide knob 203.

The objective of the present invention is to provide people with a cleaning apparatus used to clean the rim of a toilet bowl and the seat of a toilet. The present invention makes it easy for people to clean dirty things and contaminated areas on the rim and the seat of a toilet. When a user cleans a toilet with this apparatus, the user holds the handles of the apparatus. It is the apparatus that clamps a piece of toilet paper and directly touches dirty things instead of the user's hand. This helps people feel better when they are doing this kind of unpleasant work.

The present invention is very easy to assemble. Only two steps are needed to finish the assembling. In step 1, clip the slide knob 203 onto slide track 14 of gripping member 201 by slightly squeezing the slide track 14 into the slot of the slide knob 203 as shown in FIG. 6. In step 2, align pivot 7 on gripping member 201 with the pivot fitting hole 8 on opposite gripping member 202. Assemble them as shown in FIG. 7. Close the two gripping members. The assembling process is finished and the apparatus is ready to use.

The present invention is very easy to use. The procedure of using this apparatus includes four steps. Step 1: Tear a strip of toilet paper 25 from a toilet paper roll and hang it on outer beam 17 of the gripping member 201 as shown in FIG. 8. Step 2: Roll the strip of toilet paper 25 around the gripping end 9 in the direction as shown in FIG. 9. Step 3: Clamp the rolled toilet paper 25 as shown in FIG. 10. Step 4: Spray water or cleaning solution on the rim 103 or the seat 104 of a toilet. Use the apparatus to wipe off dirty things or dirty areas on the rim of a toilet bowl and/or on the seat of a toilet as shown in FIG. 1 and FIG. 2. After cleaning, open the gripping members and push the slide knob 203 down along the slide track 14 to dispose the used tissue as shown in FIG. 11.

The advantages of this invention are as follows.

[1] This apparatus is easy to use. You use it as easy as you use a pair of scissors.

[2] This apparatus protects a user's hand from dirty things on the seat of a toilet and/or on the rim of a toilet bowl when he/she uses this apparatus to clean the toilet. The steps 6 and 10 on gripping member 201 and opposite gripping member 202 raise handles 1 and 2 about 10 mm above gripping ends 9 and 13 so as to allow a user's holding fingers to be above a cleaning surface. This design guarantees the user's fingers not to touch a dirty surface.

[3] The slide knob 203 can slide along the slide track 14 on the gripping member 201. This mechanism makes it easy to discard the used toilet paper wrapped on the gripping end 9. During this process the user's finger does not touch the used toilet paper.

[4] The length of toilet paper loading slot 15 on the gripping member 201 is 10 mm shorter than standard toilet paper width. So when a strip of toilet paper 25 wraps on the gripping end 9, the toilet paper roll 25 completely covers the gripping end 9 (including its tip) in order to protect the gripping end 9 from dirty things when it is doing cleaning work.

[5] The Z-shaped crown on the pivot 7 provides a better constraint that prevents the opposite gripping member 202 from going out of control along the axial direction of the pivot 7 and reduces wobbling.

[6] The ratchet tooth 3 and the opposite ratchet tooth 4 can clench to each other (Refer to FIG. 4). They help to clamp the toilet paper roll 25 in place and hold it firmly. When the apparatus is not in use, you may also click the handles to hold them together and hang the apparatus on wall.

References Cited:
U.S. Patent Documents
U.S. Pat. No. 5,941,379 8/1999 Barardo 206/209
U.S. Pat. No. 5,596,774 1/1997 Howard 4/420
U.S. Pat. No. 5,630,243 5/1997 Federico et al 15/104.94
U.S. Pat. No. 7,509,693 B1 3/2009 Graves et al 4/233
U.S. Pat. No. 5,813,057 9/1998 Descent et al 4/233
U.S. Pat. No. D620,568 S 7/2010 Giovannoni D23/31 1
U.S. Pat. No. 5,806,105 9/1998 Yu 4/233
U.S. Pat. No. 4,924,532 5/1990 Pennestri 4/233; 4/222
U.S. Pat. No. 4,063,316 12/1977 Hüninghaus 4/233; 4/1
U.S. Pat. No. 5,473,789 12/1995 Oster 15/104.94; 15/227

What is claimed is:

1. An apparatus for cleaning the rim of a toilet bowl and the seat of a toilet, comprising, in combination:

a. A gripping member comprising:
A handle with a pivot and a ratchet tooth on it, and
A gripping end connected to said handle with a step, b. An opposite gripping member comprising:
An opposite handle with a pivot hole configured to fit said pivot on said gripping member and an opposite ratchet tooth configured to fit said ratchet tooth on said gripping member so as to achieve clench function, and
An opposite gripping end connected to said opposite handle with the other step which has the same height as that in said gripping member, c. A slide knob configured to slide on a slide track of said gripping member, d. Wherein the gripping end of said gripping member has a toilet paper loading slot configured to receive toilet paper for cleaning the rim and seat of the toilet.

2. An apparatus according to claim 1, wherein said gripping end of said gripping member is a flat beam and the toilet paper loading slot is formed as an open loop dividing said gripping end into an outer beam and an inner arm.

3. An apparatus according to claim 2, wherein said outer beam includes said slide track and a slide slot configured to allow said slide knob to clip on said slide track and slide along said slide track.

4. An apparatus according to claim 3, wherein said slide track is 1 mm thicker than the rest of said gripping end so that said gripping member and said opposite gripping member can achieve gripping function when rotating around said pivot.

5. An apparatus according to claim 3, wherein said slide slot is a closed-loop slot within said outer beam and is used to restrict the movement range of said slide knob.

6. An apparatus according to claim 1, wherein said slide knob comprising a. A holding wing, and b. A pushing wing, whose inner surface is even with the inner surface of said holding wing, and c. A slide track clamp configured to clamp said slide knob on said slide track with said holding wing and said pushing wing.

7. An apparatus according to claim 6, wherein said holding wing has a half-cylindrical groove located on its inner surface configured to fit a half-cylindrical groove fitting on said gripping member.

8. An apparatus according to claim 1, wherein both said gripping end and said opposite gripping end have 1° angle between their own two longer sides.

9. An apparatus according to claim 1, wherein said steps on said gripping member and said opposite gripping member are 10 mm high and have 135° angle with said gripping end and said opposite gripping end respectively.

10. An apparatus according to claim 1, wherein said opposite gripping end is 22 mm shorter than said gripping end so as to create a sitting space for said slide knob when said slide knob is not in use.

11. An apparatus according to claim 1, wherein said pivot has a "Z"-shaped crown which prevents said opposite gripping member from getting out of said pivot and reduces wobbling when said opposite gripping member rotates around said pivot.

12. An apparatus according to claim 1, wherein said gripping member and said opposite gripping member have four rib stiffeners respectively to increase their stiffness.

* * * * *